United States Patent [19]

Stafford

[11] Patent Number: 4,918,890

[45] Date of Patent: Apr. 24, 1990

[54] GARAGE DOOR ANTISAG DEVICE

[76] Inventor: Thomas A. Stafford, 3116 Jordan St., Boise, Id. 83702

[21] Appl. No.: 313,190

[22] Filed: Feb. 21, 1989

[51] Int. Cl.[5] ..... E04G 23/00

[52] U.S. Cl. ..... 52/291; 52/149

[58] Field of Search ..... 52/149, 291, 127.2, 52/150.151, 226

[56] References Cited

U.S. PATENT DOCUMENTS

| | | | |
|---|---|---|---|
| 1,167,790 | 1/1916 | Benson | 52/226 X |
| 2,597,786 | 5/1952 | Fontaine | 52/291 X |
| 2,795,015 | 6/1957 | foley | 52/291 |
| 2,804,953 | 9/1957 | Buehler | 52/291 X |
| 4,038,803 | 8/1977 | Schoeller | 52/291 X |

*Primary Examiner*—David A. Scherbel
*Assistant Examiner*—Creighton Smith
*Attorney, Agent, or Firm*—Frank J. Dykas; Craig M. Korfanta

[57] ABSTRACT

A garage door antisag device which uses pairs of adjustable tensive members 11 which are adapted to diagonally attach across single or multiple panels 2, 3, and 4 to hinge plates 5 and bolts 6 of a standard wooden paneled garage door 1. Each tensive member 11 has a pair of rods 12 axially coupled by turnbuckle 15. One rod 12 is provided with right hand threads 16 while the other is provided with left hand threads 17 at their first ends 13. The second ends of the rods are provided with loops which define off set eyeholes 14 for engaging the hinge bolts 6 of the garage door 1.

2 Claims, 3 Drawing Sheets

GARAGE DOOR ANTISAG DEVICE

BACKGROUND OF THE INVENTION

1. Technical Field

This invention generally relates to devices for enhancing structural integrity, and in particular, it relates to a device for remedying and preventing sagging in a wooden paneled garage door.

2. Background Art

Because garage doors are only supported at the width defining edges by rollers and rails, there is a substantial amount of stress at the center of the garage door. In wooden paneled garage doors, over time this stress results in the middle of the door sagging. Typical life expectancy is around fifteen years for wooden paneled doors, simply because of the sagging problem.

JERILA, U.S. Pat. No. 3,910,003, teaches a door stiffener consisting of a torsion bar for stiffening lightweight panel doors having a thin wood or composition panel and metal stiles and rails around the periphery. The stiffener uses brackets to engage the periphery rails and hold a torsion bar. It is designed to prevent twisting and racking of the panel. While the device of Jerila could be adapted to support multiple panels and panel joints using multiple brackets and a single torsion bar, it is not capable of remedying or removing the existing sag in a wooden paneled door. This is because sag in garage doors occurs in two directions. The first direction is normal to the plane of the door while the second lies in the plane and is coincident the transverse center.

HENSCHEN, U.S. Pat. No. 3,574,981, teaches an adjustable brace for use by carpenters in the erection and plumbing of vertical walls. The device consists of a pair of elongated struts axially coupled by a turnbuckle. The elongated struts each have a pivotally hinged anchor attached to their non-turnbuckle ends. The anchors are anchored by nails to the vertical wall and floor of the structure. Unfortunately, the device of Henschen is not well suited for use on wooden paneled garage doors.

What is needed is a tensive member which can be diagonally attached across one or more panels of a wooden garage door which remedies and prevents sagging of the garage door. It is therefore an object of the present invention to provide such a device.

DISCLOSURE OF INVENTION

This and other objects are accomplished by an antisag device which uses pairs of adjustable tensive members which are adapted to diagonally attach across a single or multiple panels to the hinge plates and bolts of a standard wooden paneled garage door. Each tensive member has a pair of rods axially coupled by a turnbuckle. One rod is provided with right hand threads while the other is provided with left hand threads at their first ends. The second ends of the rods are provided with loops which define off set eyeholes for engaging the hinge bolts of the garage door.

In use, the pairs are attached to the garage door in a V-shaped formation across a horizontal row of panels by engaging the off set eyeholes with the hinge plate bolts. The two turnbuckles are then alternately tightened to put the two tensive members or struts under tension. Multiple pairs can be used for multiple rows of horizontal panels.

Over a period of time, the turnbuckles of the pairs of tensive members can be alternately tightened, thereby removing or remedying the sag in the garage door. Installation of the antisag device on a straight door prevents sagging from occurring.

BEST MODE FOR CARRYING OUT INVENTION

Figure 1:
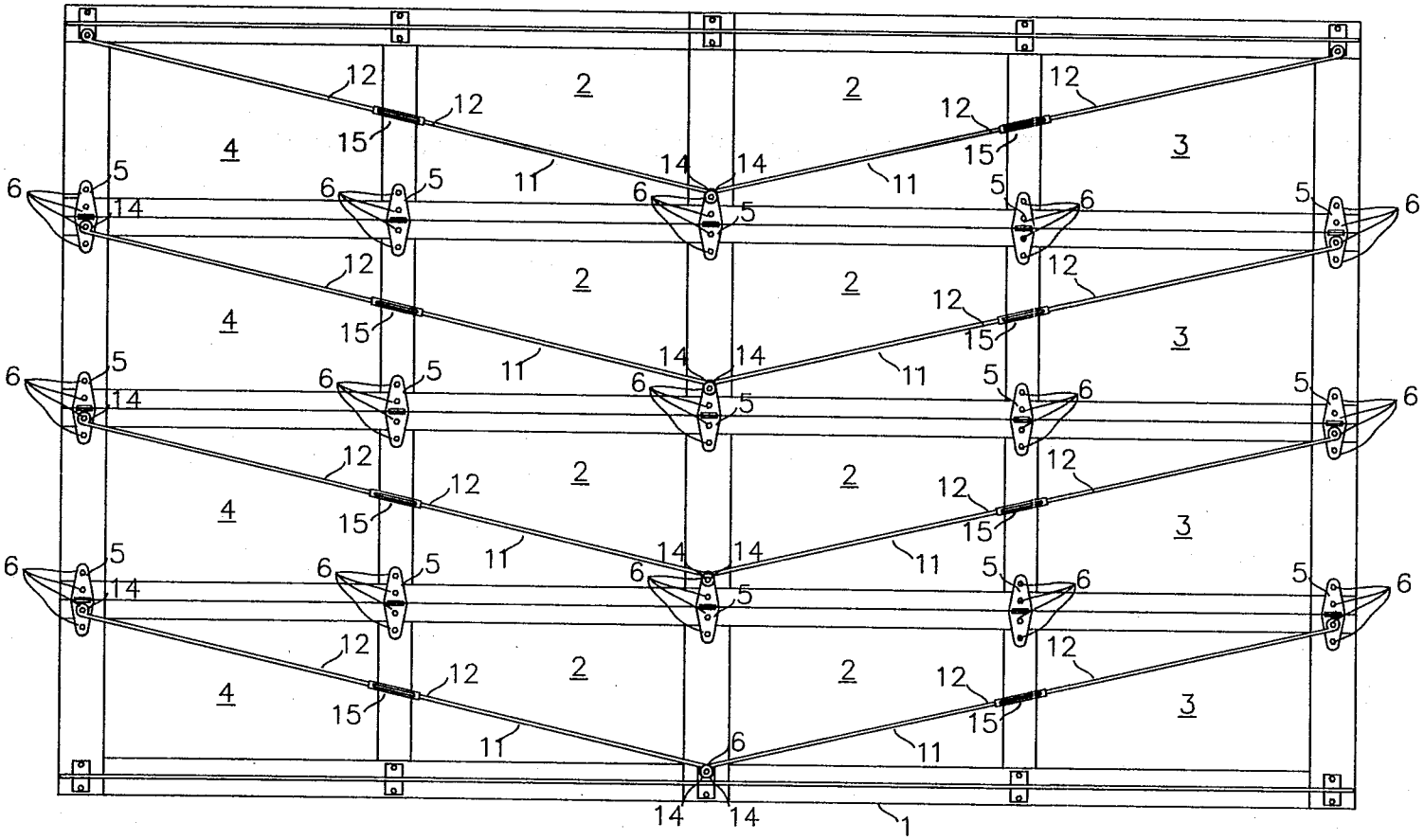
FIG. 1 is a plan view of the inside of a paneled garage door using the antisag device.
Figure 2:
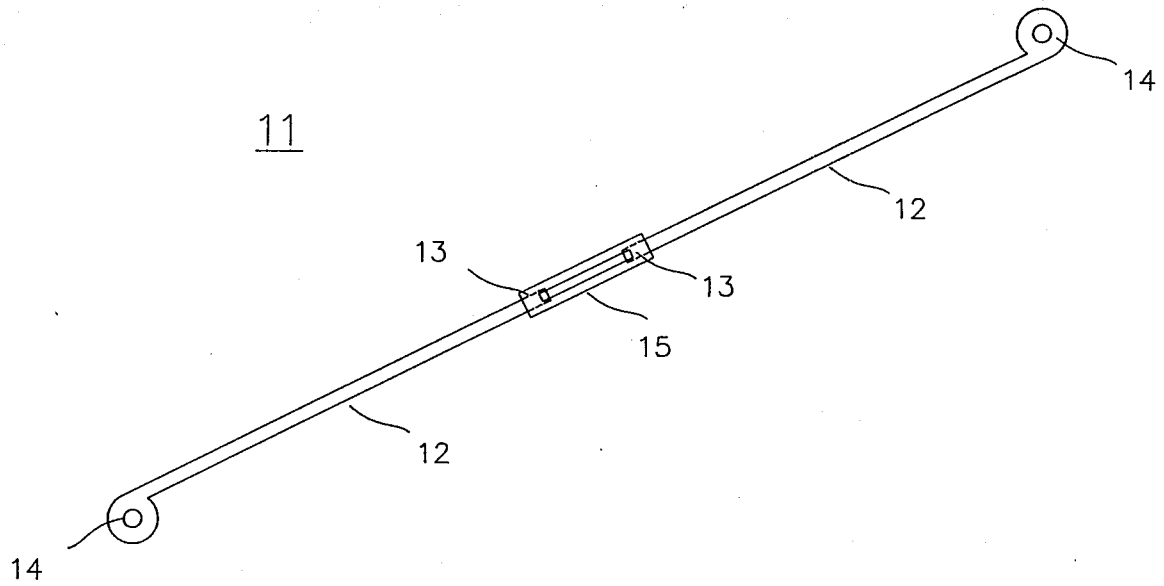
FIG. 2 is a plan view of a tensive member.
Figure 3:
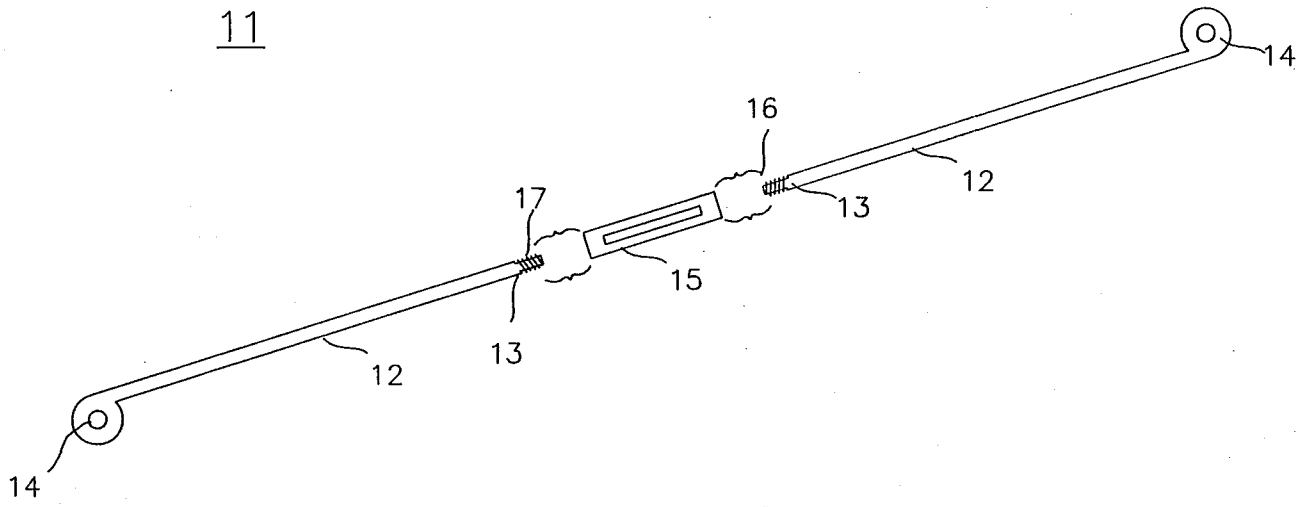
FIG. 3 is an exploded plan view of a tensive member.

Referring now to FIGS. 1, 2, and 3, the garage door antisag device is shown and generally has pairs of tensive members 11 diagonally attached in V-shaped formation across rows of horizontal panels 2, 3, and 4. The rectangular width defining panels 2, 3, and 4 are generally wooden or composite in construction. The right most panels are designated as right hand panels 3 while the left most panels are designated as left hand panels 4. Panels 2, 3, and 4, are joined together and hingedly attached in horizontal rows to define garage door 1. Garage door 1 is generally supported by rollers and rails neither of which are shown. Tensive members 11 are diagonally attached across panels 2, 3, and 4, by engagement with hinge plate bolts 6 of hinge plates 5.

FIG. 2 shows tensive member 11 having a pair of rods 12 axially coupled at their first ends 13 by turnbuckle 15. Loops or off set eyeholes 14 are provided in the second ends of rods 12 to engage hinge plates 5 and hinge plates bolts 6 shown in FIG. 1. The engagement holes at the second ends must be off set to facilitate attachment of tensive members 11 to garage door 1.

FIG. 3 shows an exploded view of tensive member 11 which shows one rod 12 having right hand threads 16 while the other rod 12 has left hand threads 17. Obviously this is necessary to have the turnbuckle function properly. In use, the pairs are attached to garage door 1 in a V-shaped formation across a horizontal row of panels 2, 3, and 4 by engaging off set eyeholes 14 with hinge plate bolts 6. Turnbuckles 15 are then alternately tightened to put tensive members 11 under tension. Multiple pairs of tensive members 11 can be used for multiple rows of horizontal panels.

While there is shown and described the present preferred embodiment of the invention, it is to be distinctly understood that this invention is not limited thereto but may be variously embodied to practice within the scope of the following claims.

I claim:

1. An antisag device for use on garage doors having at least two width defining rectangular panels, one being the right hand panel and the other being the left hand panel, which comprises a pair of adjustable tensive members having off set eyeholes at first and second ends and wherein a first tensive member is tensively and diagonally attached across the right hand panel were said first end of said first tensive member is attached to the upper right hand corner of the right hand panel while said second end is attached to a center point between the lower left hand corner of the right hand panel and the lower right hand corner of the left hand panel and further wherein a second tensive member is tensively and diagonally attached across the left hand panel where said first end of said second tensive member is attached to the upper left hand corner of the left hand panel while said second end is attached to said center point.

2. An antisag device for use on garage doors having at least two width defining rectangular panels, one being the right hand panel and the other being the left hand panel which comprises:

at least four rods wherein each of said rods has a threaded first end and a second end having an off set eyehole, for receiving a bolt therethrough;

at least two turnbuckles, each being threadedly engaged with a pair of said rods, thereby defining first and second pairs of rods;

said turnbuckle and said pair of rods together having a length slightly greater than the length of the panel's diagonal;

wherein a first eyehole of said first pair of rods is attached to the upper right hand corner of the right hand panel while a second eyehole of said first pair is attached to a center point between the lower left hand corner of said right hand panel and the lower right hand corner of said left hand panel; and wherein a first eyehole of said second pair of rods is attached to the upper left hand corner of the left hand panel while a second eyehole of said second pair is attached to said center point.

* * * * *